US009066611B1

(12) United States Patent
Bailey

(10) Patent No.: US 9,066,611 B1
(45) Date of Patent: Jun. 30, 2015

(54) JEWELRY ORGANIZER

(76) Inventor: Tina Bailey, Dallas, TX (US)

( * ) Notice: Subject to any disclaimer, the term of this patent is extended or adjusted under 35 U.S.C. 154(b) by 0 days.

(21) Appl. No.: 12/432,608

(22) Filed: Apr. 29, 2009

Related U.S. Application Data

(63) Continuation-in-part of application No. 29/334,960, filed on Apr. 6, 2009, now Pat. No. Des. 608,564, and a continuation-in-part of application No. 29/334,961, filed on Apr. 6, 2009, now Pat. No. Des. 608,110.

(51) Int. Cl.
*A45C 11/04* (2006.01)
*A47F 5/00* (2006.01)
*A45C 11/16* (2006.01)

(52) U.S. Cl.
CPC ..... *A47F 5/0006* (2013.01); *A45C 11/16* (2013.01)

(58) Field of Classification Search
CPC ..... A47F 5/0006; A47F 7/02; A45C 11/16
USPC ..... 206/6.1, 566, 383, 49, 388; 211/85.2
See application file for complete search history.

(56) References Cited

U.S. PATENT DOCUMENTS

| | | | | |
|---|---|---|---|---|
| 377,339 | A | 1/1888 | Ulke | |
| 579,523 | A * | 3/1897 | Turner | 206/388 |
| 1,044,260 | A | 11/1912 | Schloss | |
| D101,594 | S | 10/1936 | Carley | |
| 2,962,156 | A | 11/1960 | Adams et al. | |
| 3,537,625 | A | 11/1970 | Nuttall | |
| 4,069,920 | A * | 1/1978 | Ross | 211/106.01 |
| 4,120,394 | A | 10/1978 | Soltes | |
| D268,890 | S | 5/1983 | Morin | |
| 4,461,383 | A * | 7/1984 | Groff | 206/6.1 |
| 4,546,888 | A | 10/1985 | Rosberg et al. | |
| 4,732,269 | A * | 3/1988 | Roy | 206/751 |
| 5,129,510 | A * | 7/1992 | Wright | 206/6.1 |
| 5,242,048 | A * | 9/1993 | Ellingsworth et al. | 206/6.1 |
| 5,379,888 | A * | 1/1995 | Rentos | 206/265 |
| 5,452,806 | A * | 9/1995 | Campas | 211/85.2 |
| 5,743,394 | A | 4/1998 | Martin | |
| 5,988,408 | A | 11/1999 | Evans et al. | |
| 6,062,236 | A * | 5/2000 | Gaudet | 206/49 |
| D431,905 | S | 10/2000 | McCormack | |
| D496,582 | S | 9/2004 | Heck | |
| D547,584 | S | 7/2007 | Little | |
| D556,025 | S | 11/2007 | Kubota | |
| 7,438,607 | B2 | 10/2008 | Fong | |
| 2003/0024890 | A1 | 2/2003 | Vollmer | |
| 2008/0166929 | A1 | 7/2008 | Fong | |
| 2009/0120885 | A1 | 5/2009 | Kao | |
| 2009/0218303 | A1 | 9/2009 | Winnard | |

* cited by examiner

*Primary Examiner* — Mickey Yu
*Assistant Examiner* — Chun Cheung
(74) *Attorney, Agent, or Firm* — Winstead PC

(57) ABSTRACT

A jewelry organizer includes a generally rectangular-shaped body surrounded with a cover and a plurality of securing members attached to the cover at a top surface of the generally rectangular-shaped body. The plurality of securing members are uniformly spaced apart along an entire length of the top surface of the generally rectangular-shaped body.

9 Claims, 10 Drawing Sheets

JEWELRY ORGANIZER

CROSS-REFERENCE TO RELATED APPLICATIONS

This application is a continuation-in-part of U.S. application Ser. No. 29/334,960, filed Apr. 6, 2009 now U.S. Pat. No. D608,564. This application is a continuation-in-part of U.S. application Ser. No. 29/334,961, filed Apr. 6, 2009 now U.S. Pat. No. D608110. U.S. application Ser. No. 29/334,960 and U.S. application Ser. No. 29/334,961 are incorporated herein by reference in their entirety.

TECHNICAL FIELD

The invention relates generally to jewelry organizers and, in particular, to a body for receiving and storing jewelry while eliminating tangling, knotting, and/or kinking of the jewelry.

BACKGROUND

Entanglement, knotting, and/or kinking of chain jewelry such as, for example, necklaces, bracelets, and ankle-bracelets creates significant problems during storage. Typically, such jewelry is loosely stored in jewelry boxes where the jewelry gets entangled. Conventional jewelry boxes include a receptacle and lid and separate portions for storing at least a necklace and a pendant. Such jewelry boxes are bulky and non-collapsible, resulting in the jewelry boxes being difficult to store and transport.

Other jewelry holders comprise trays including a plurality of hooks for hanging the jewelry vertically. Such jewelry holders are bulky and cannot be stored in a confined space. In addition, moving such jewelry holders from one location to another results in substantial risk of entanglement of, for example, a plurality of chain necklaces. It is desirable to have a jewelry organizer that is light-weight and portable. Additionally, it is desirable to have a jewelry organizer that prevents entanglement, knotting, and/or kinking of chain jewelry such as, for example, necklaces, bracelets, and ankle-bracelets.

SUMMARY OF THE INVENTION

A jewelry organizer including a generally rectangular-shaped body surrounded with a cover and a plurality of securing members attached to the cover on a surface of the generally rectangular-shaped body. The plurality of securing members are uniformly spaced apart along an entire length of the surface of the generally rectangular-shaped body.

A method of using a jewelry organizer to eliminate knotting and kinking of at least one necklace. The method includes engaging a clasp region of the at least one necklace within at least one securing member and positioning a free end of the necklace vertically below the at least one securing member. The method further includes wrapping the necklace around a circumference of a body of the jewelry organizer until the free end of the necklace is positioned vertically below the body between the at least one securing member engaging the clasp region of the necklace and at least another adjacent securing member.

A method of using a jewelry organizer to eliminate knotting and kinking of at least one necklace. The method includes engaging a clasp region of the at least one necklace within at least one securing member, positioning a free end of the necklace vertically below the at least one securing member, and wrapping the necklace around a circumference of a body of the jewelry organizer until the free end of the necklace is positioned vertically below at least another securing member adjacent the at least one securing member engaging the clasp region of the necklace. The method further includes inserting the free end of the necklace between the at least another securing member and a surface of the body.

BRIEF DESCRIPTION OF THE DRAWINGS

A more complete understanding of various embodiments of the invention may be obtained by reference to the following Detailed Description when taken in conjunction with the accompanying Drawings wherein.

DETAILED DESCRIPTION OF ILLUSTRATIVE EMBODIMENTS OF THE INVENTION

Figure 1:
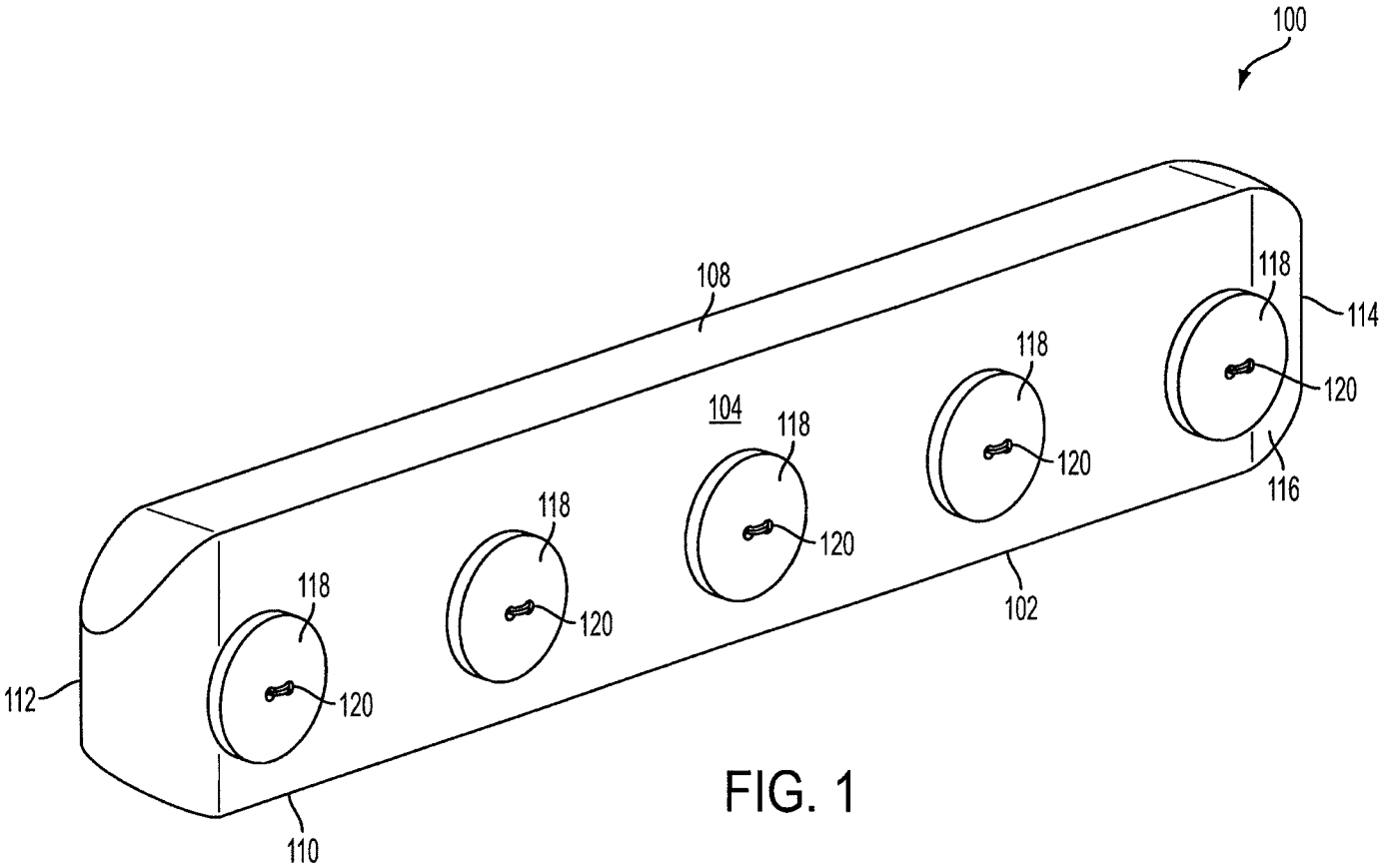
FIG. 1 illustrates a perspective view of a jewelry organizer according to an exemplary embodiment.

Various embodiments of the invention will now be described more fully with reference to the accompanying drawings. The invention may, however, be embodied in many different forms and should not be construed as limited to the embodiments set forth herein; rather, the embodiments are provided so that this disclosure will be thorough and complete, and will fully convey the scope of the invention to those skilled in the art. The above summary of the invention is intended to represent exemplary embodiments of the invention.

With reference now to the drawings, and in particular to FIGS. 1-6B thereof, a novel jewelry organizer embodying the principles and concepts of the invention and generally designated by the reference numeral 100 will be described. The embodiments described herein are intended as an exemplary jewelry organizer 100 for use by retailers such as, for example, jewelry store owners and individuals for organizing and storing jewelry.

Referring now to FIGS. 1-6B, a first embodiment of the jewelry organizer 100 will be described in detail. The jewelry organizer 100 includes a substantially rectangular-shaped body 102. For exemplary purposes, a substantially rectangular-shaped body 102 is illustrated; however, in other embodiments of the invention, the body 102 may be other shapes such as, for example, square, donut-shaped, and the like. The jewelry organizer 100 is useful for enabling a user to organize and store chain jewelry such as, for example, necklaces or bracelets while eliminating entanglement, knotting, and/or kinking of the chain jewelry.

The body 102 includes a top surface 104, a bottom surface 106, a left side surface 108, a right side surface 110, a first end 112, and a second end 114. In a typical embodiment, the body 102 comprising the top surface 104, the bottom surface 106, the left side surface 108, the right side surface 110, the first end 112, and the second end 114 is made of a material which is light-weight, flexible, pliable, soft, and cost-efficient such as, for example, foam, cotton, down, feathers, and the like. In a typical embodiment, the body 102 is surrounded with a cover or shell 116 in a conventional manner for enhancing the appearance of the jewelry organizer 100. In a typical embodiment, the cover or shell 116 is made of, for example, fabric. In a typical embodiment, the fabric may be, for example, silk, cotton, leather, suede, and the like. In alternate embodiments, the cover or shell 116 of the jewelry organizer 100 may be used for advertising purposes by depicting information such as, for example, a retailer's contact information, product information, company information, and any other information for advertising purposes.

The top surface 104 comprises at least one securing member 118. In a typical embodiment, the at least one securing member 118 is attached to the cover or shell 116 at the top surface 104 via, for example, a fastening mechanism 120. For exemplary purposes, stitching 120 is illustrated for fastening the at least one securing member 118 to the cover or shell 116; however, in other embodiments of the invention, the at least one securing member 118 may be attached to the cover or shell 116 via, for example, stapling, gluing, and the like. In a typical embodiment, the at least one securing member 118 may be, for example, a button, a clasp, a hook, or any other mechanism for receiving or having inserted therein a portion of the chain jewelry such as, for example, a necklace, a bracelet, and the like. For exemplary purposes, a plurality of uniformly spaced apart buttons 118 along an entire length of the top surface 104 are illustrated as the at least one securing member 118; however, in other embodiments of the invention, the plurality of buttons 118 may be replaced with clasps, hooks, and the like.

Figure 2:
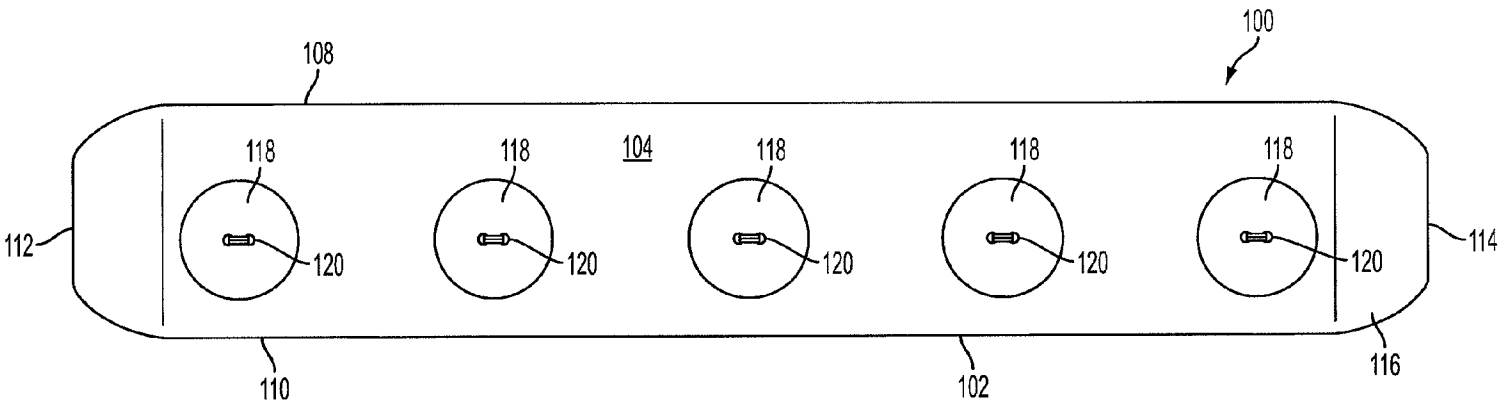
FIG. 2 illustrates a top view of a jewelry organizer according to an exemplary embodiment.
Figure 3:
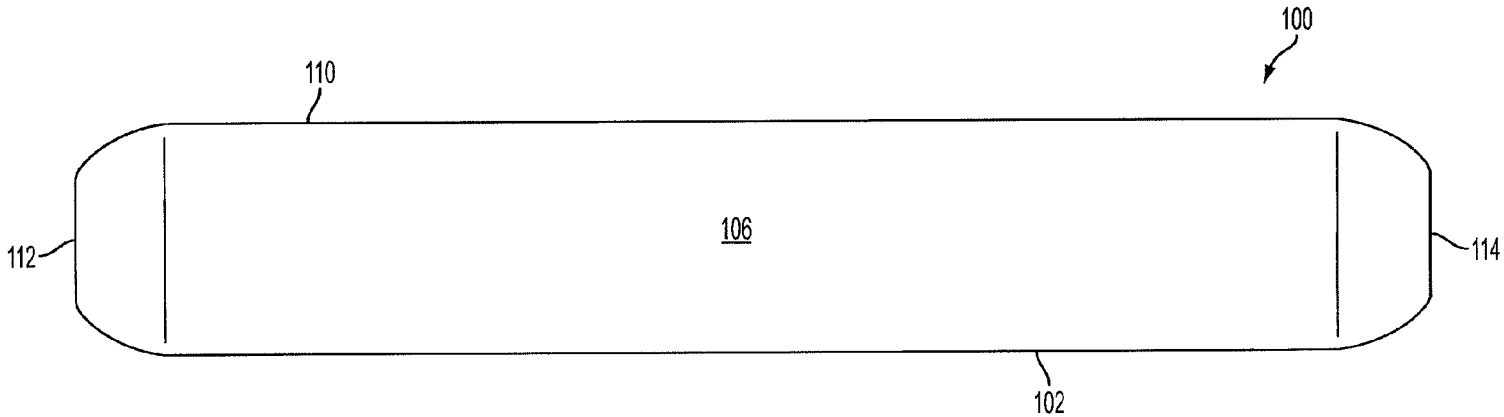
FIG. 3 illustrates a bottom view of a jewelry organizer according to an exemplary embodiment.
Figure 4:
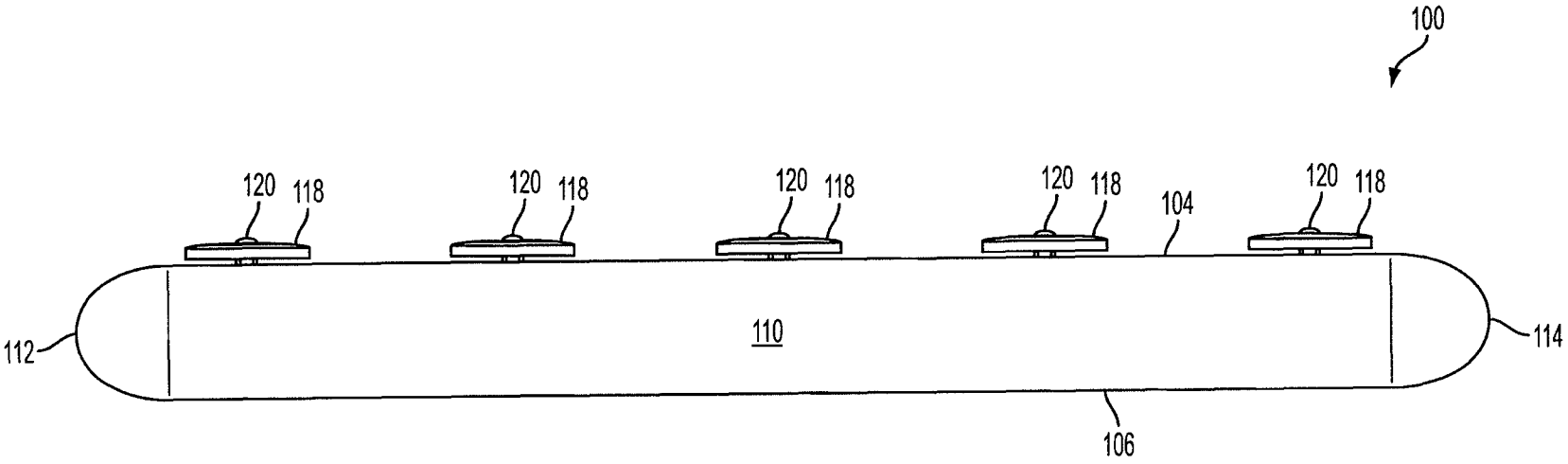
FIG. 4 illustrates a side view of a jewelry organizer according to an exemplary embodiment.

FIGS. 2-4 illustrate top, bottom, and side views, respectively, of a jewelry organizer 100 according to an exemplary embodiment.

Figure 5:
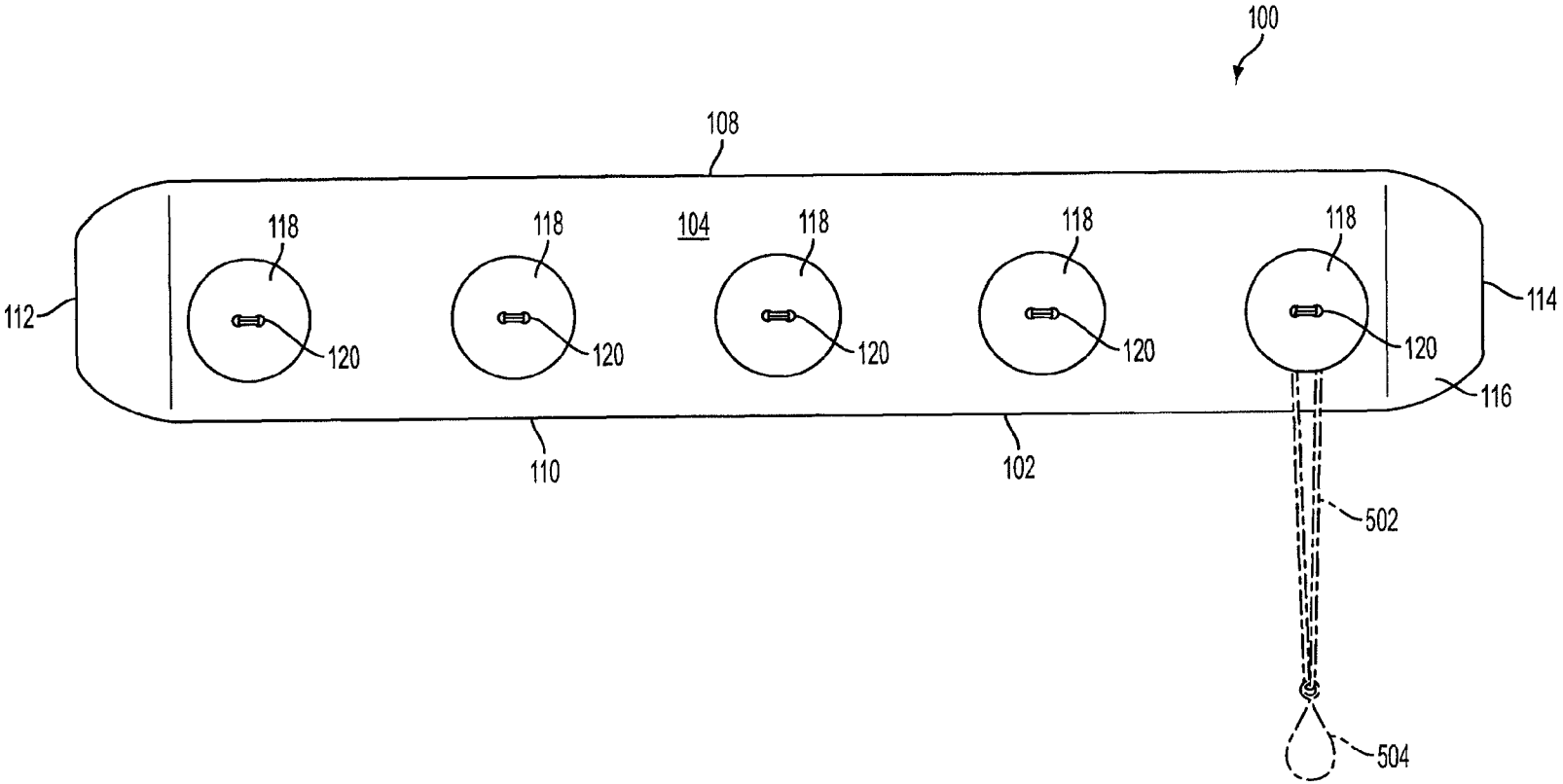
FIG. 5 illustrates a top view of a jewelry organizer in use according to an exemplary embodiment.
Figure 6A:
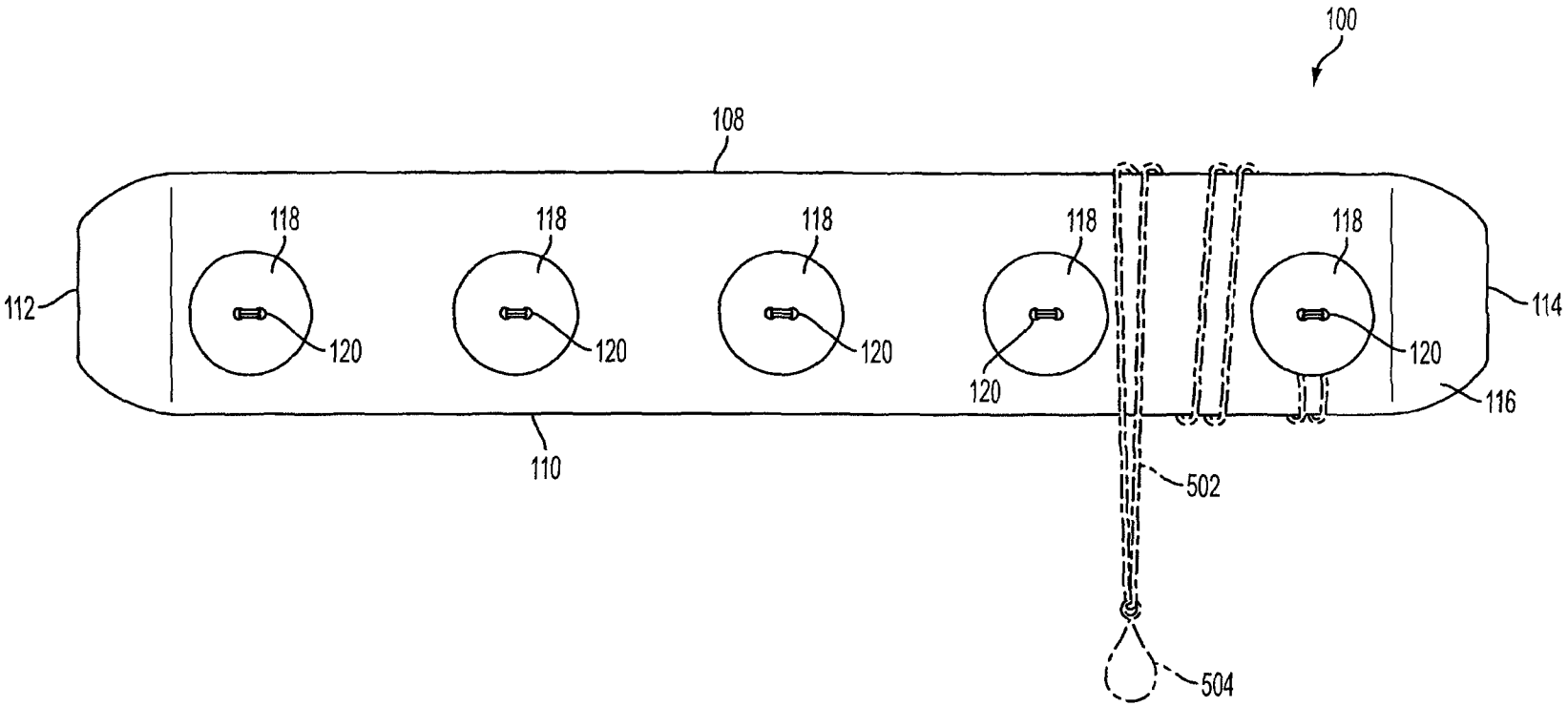
FIG. 6A illustrates a top view of a jewelry organizer in use according to an exemplary embodiment.

With reference to FIGS. 5 and 6A, an exemplary manner of using the jewelry organizer 100 will now be described. FIGS. 5 and 6A further illustrate a clasped necklace 502 and a pendant 504 at a free end of the necklace 502. In a typical embodiment, the at least one securing member 118 is operable to receive a portion of the necklace 502 comprising a clasp member (not explicitly shown). In this arrangement, the at least one securing member 118 engages the portion of the necklace 502 comprising the clasp member and retains the necklace 502 in a position such that the pendant 504 is positioned vertically below the at least one securing member 118 engaging the portion of the necklace 502. In a typical embodiment, the at least one securing member 118 and the top surface 104 of the body 102 provides sufficient frictional force to retain the portion of the necklace 502 in position and precludes the portion of the necklace 502 from shifting.

Next, the necklace 502 is wrapped around an entire circumference of the body 102 until a free end of the necklace 502 which may be, for example, the pendent 504 is positioned vertically below the body 102 between the at least one securing member 118 engaging the portion of the necklace and at least another securing member 118. In a typical embodiment, the necklace 502 is circumferentially wrapped around a body region between the at least one securing member 118 engaging the portion of the necklace 502 and at least another adjacent securing member 118. The arrangement of the necklace 502 as illustrated in FIGS. 5-6A prevents entanglement, knotting, and/or kinking of necklaces or other similar chain jewelry. The arrangement further provides display, support, and storage of the chain jewelry in an attractive and demonstrative fashion that is easily provided and quickly available while still retaining the arrangement in an organized manner in storage.

Figure 6B:
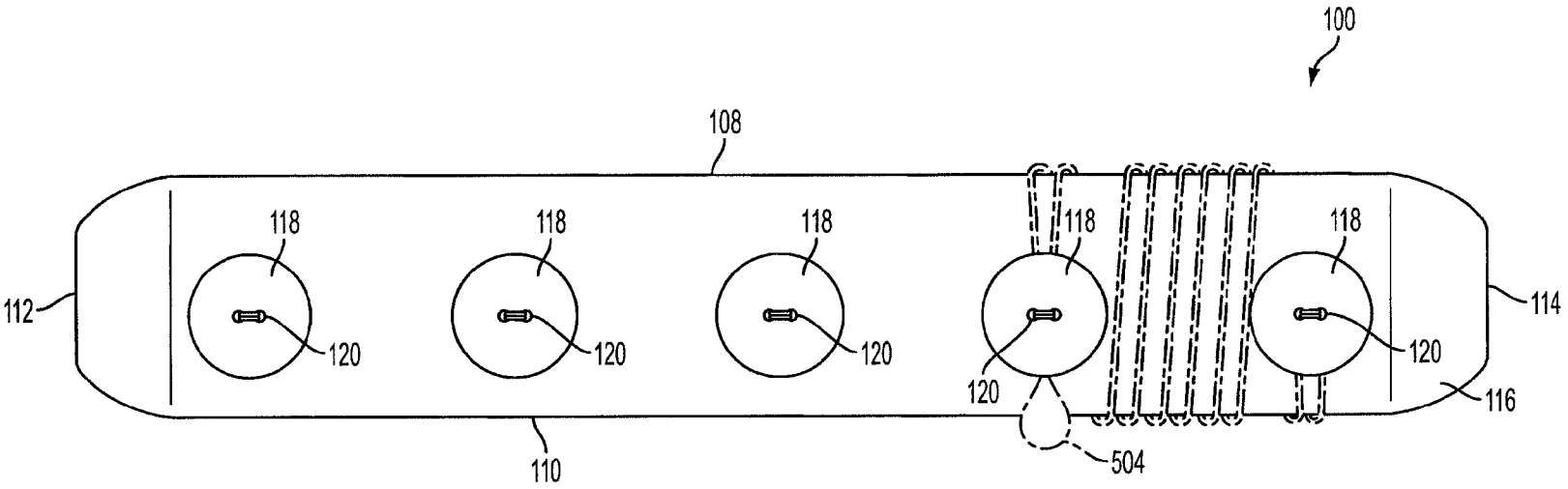
FIG. 6B illustrates a top view of a jewelry organizer in use according to an exemplary embodiment.

With reference to FIGS. 5 and 6B, an alternate manner of using the jewelry organizer 100 will now be described. FIGS. 5 and 6B further illustrate a clasped necklace 502 and a pendant 504 at a free end of the necklace 502. In a typical embodiment, the at least one securing member 118 is operable to receive a portion of the necklace 502 comprising a clasp member (not explicitly shown). In this arrangement, the at least one securing member 118 engages the portion of the necklace 502 comprising the clasp member and retains the necklace 502 in a position such that the pendant 504 is positioned vertically below the at least one securing member 118 engaging the portion of the necklace 502. In a typical embodiment, the at least one securing member 118 and the top surface 104 of the body 102 provides sufficient frictional force to retain the portion of the necklace 502 in position and precludes the portion of the necklace 502 from shifting.

Next, the necklace 502 is wrapped around an entire circumference of the body 102 until the necklace 502 is unable to be wrapped around the body 102 and a free end of the necklace 502 which may be, for example, the pendent 504, is positioned vertically below at least one securing member 118 adjacent to the at least one securing member 118 engaging the portion of the necklace 502. In a typical embodiment, the necklace 502 is circumferentially wrapped around a body region between the at least one securing member 118 engaging the portion of the necklace 502 and at least another adjacent securing member 118. Next, the pendant 504 is inserted between the at least another securing member 118 and the top surface 104 of the body 102. The arrangement of the necklace 502 as illustrated in FIGS. 5 and 6B prevents entanglement, knotting, and/or kinking of necklaces or other similar chain jewelry. The arrangement further provides display, support, and storage of the chain jewelry in an attractive and demonstrative fashion that is easily provided and quickly available while still retaining the arrangement in an organized manner in storage. In a typical embodiment, the number of times the necklace 502 is wrapped around the body 102 depends upon a length of the necklace 502. For exemplary purposes, FIG. 6B illustrates the necklaces 502 looped around the body 102 five times; however, in other embodiments of the invention, the total number of loops may vary depending on the length of the necklace 502.

In certain embodiments of the invention, the necklace 502, a portion of which is engaged by the at least one securing member 118, is wrapped around an entire circumference of the body 102 until the necklace 502 is unable to be wrapped around the body 102. Next, a free end of the necklace 502 which may be, for example, the pendent 504, is positioned vertically below the at least one securing member 118 engaging the portion of the necklace 502, and the pendant 504 is inserted between the at least one securing member 118 and the top surface 104 of the body 102.

The exemplary necklace 502 is also easily removed from the body 102 by unwrapping the necklace 502 from the body 102 and than disengaging the portion of the necklace 502 from the at least one securing member 118. As such, the jewelry organizer 100 can be effectively utilized for storing chain jewelry while preventing entanglement, knotting, and/or kinking of the chain jewelry. For exemplary purposes, only five securing members 118 are disclosed; however, in other embodiments of the invention, any number of securing members 118 may be present on the top surface 104 of the body 102. In addition, the jewelry organizer 100 is illustrated as a substantially rectangular-shaped body 102; however, in other embodiments of the invention, the body 102 may be other shapes such as, for example, square, donut-shaped, and the like. In a typical embodiment, the jewelry organizer is manufactured in various sizes as needed. For illustrative purposes, only one necklace 502 is illustrated in FIGS. 5-6; however, in alternate embodiments, the jewelry organizer 100 may simultaneously receive multiple necklaces 502.

Figure 7:
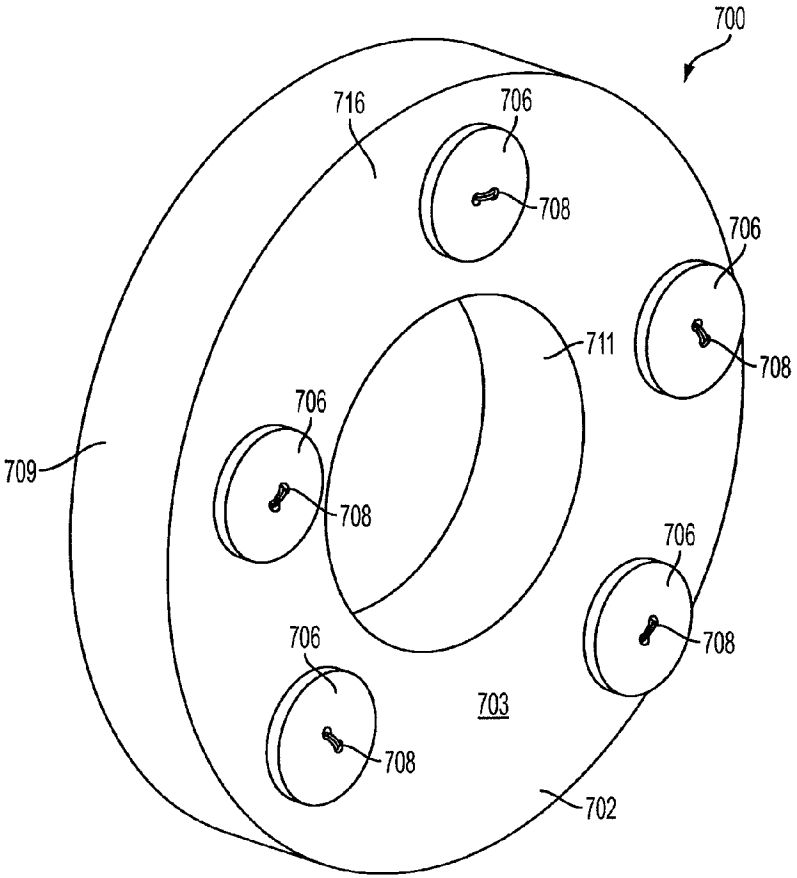
FIG. 7 illustrates a perspective view of a jewelry organizer according to an alternate embodiment.

FIG. 7 illustrates a perspective view of a jewelry organizer 700 according to an alternate embodiment. In the embodiment illustrated in FIG. 7, the jewelry organizer 700 includes a substantially donut-shaped body 702.

The jewelry organizer 700 is useful for enabling a user to organize and store chain jewelry such as, for example, necklaces, bracelets while eliminating entanglement, knotting, and/or kinking of the chain jewelry. The body 702 includes a top surface 703, a bottom surface (not explicitly shown), an outer end 709, and an inner end 711. In a typical embodiment, the body 702 comprising the top surface 703, a bottom surface (not explicitly shown), the outer end 709, and the inner end 711 is made of a material which is light weight, flexible, pliable, soft, and cost-efficient such as, for example, foam, cotton, down, feathers, and the like. In a typical embodiment, the body 703 is surrounded with a cover or shell 716 in a conventional manner for enhancing the appearance of the jewelry organizer. In a typical embodiment, the cover or shell 716 is made of, for example, fabric. In a typical embodiment, the fabric may be, for example, silk, cotton, leather, suede, and the like. In alternate embodiments, the cover or shell 716 of the jewelry organizer 700 may be used for advertising purposes by depicting information such as, for example, a retailer's contact information, product information, company information, and any other information for advertising purposes.

The top surface 703 comprises at least one securing member 706. In a typical embodiment, the at least one securing member 706 is attached to the cover or shell 716 at the surface 703 via, for example, a fastening mechanism 708. For exemplary purposes, stitching 708 is illustrated for fastening the at least one securing member 706 to the cover or shell 716; however, in other embodiments of the invention, the at least one securing member 706 may be attached to the cover or shell 716 via, for example, stapling, gluing, and the like. In a typical embodiment, the at least one securing member 706 may be, for example, a button, a clasp, a hook, or any other mechanism for receiving or having inserted therein a portion of the jewelry such as, for example, a chain necklace. For exemplary purposes, only five securing members 706 are disclosed as buttons; however, in other embodiments of the invention, any number of securing members 118 may be present on the top surface 703. The jewelry organizer 700 is useful for enabling a user to organize and store chain jewelry such as, for example, necklaces, bracelets while eliminating entanglement, knotting, and/or kinking of the jewelry in a similar manner as disclosed above with respect to FIGS. 5-6.

Figure 8:
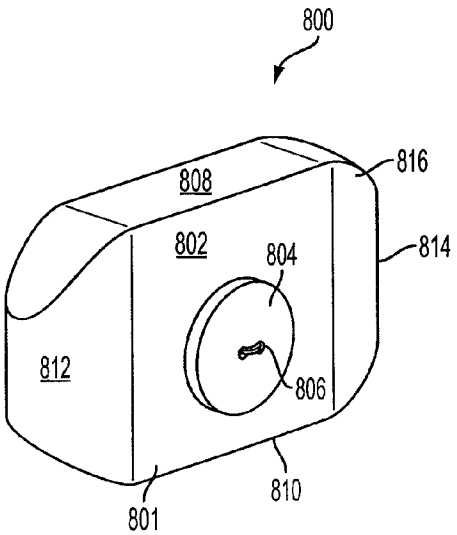
FIG. 8 illustrates a perspective view of a jewelry organizer according to another alternate embodiment.

FIG. 8 illustrates a perspective view of a jewelry organizer 800 according to an alternate embodiment. In the embodiment illustrated in FIG. 8, the jewelry organizer 800 comprises a substantially square-shaped body 801. The body 801 includes a top surface 802, a bottom surface (not explicitly shown), a left side surface 808, a right side surface 810, a first end 812, and a second end 814. In a typical embodiment, the body 801 comprising the top surface 802, the bottom surface, the left side surface 808, the right side surface 810, the first end 812, and the second end 814 is made of a material which is light-weight, flexible, pliable, soft, and cost-efficient such as, for example, foam, cotton, down, feathers, and the like. In a typical embodiment, the body 801 is surrounded with a cover or shell 816 in a conventional manner for enhancing the appearance of the jewelry organizer 800. In a typical embodiment, the cover or shell is 816 is made of, for example, fabric. In a typical embodiment, the fabric may be, for example, silk, cotton, leather, suede, and the like. In alternate embodiments, the cover or shell 816 of the jewelry organizer 800 may be used for advertising purposes by depicting information such as, for example, a retailer's contact information, product information, company information, and any other information for advertising purposes.

The top surface 802 comprises a securing member 804. In a typical embodiment, the securing member 804 is attached to the cover or shell 816 at the top surface 802 via, for example, a fastening mechanism 806. For exemplary purposes, stitching 806 is illustrated for fastening the securing member 804 to the cover or shell 816; however, in other embodiments of the invention, the securing member 804 may be attached to the cover or shell 816 via, for example, stapling, gluing, and the like. In a typical embodiment, the securing member 804 may be, for example, a button, a clasp, a hook, or any other mechanism for receiving or having inserted therein a portion of the chain jewelry such as, for example, a necklace. The jewelry organizer 800 is useful for enabling a user to organize and store the chain jewelry while eliminating entanglement, knotting, and/or kinking of the chain jewelry in a similar manner as disclosed earlier with respect to FIGS. 5-6.

Figure 9:
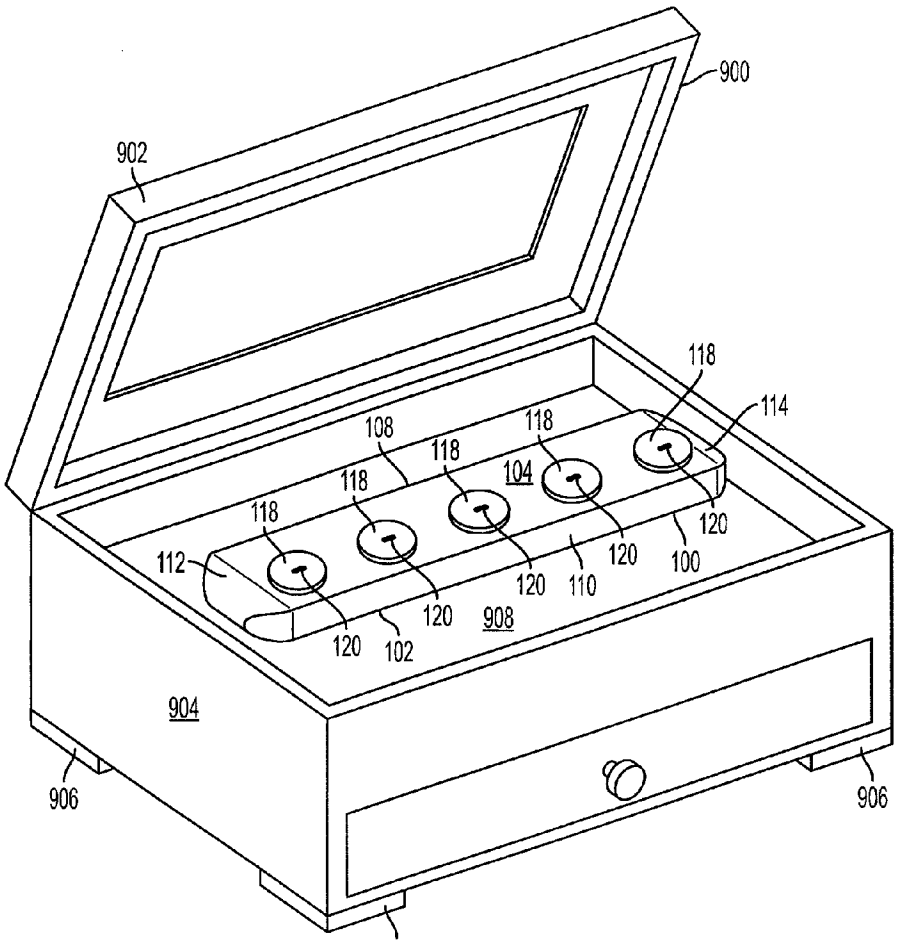
FIG. 9 illustrates a perspective view of a jewelry organizer placed within a jewelry box according to an exemplary embodiment.

FIG. 9 illustrates a perspective view of a jewelry organizer 100 of FIGS. 1-6 placed within a jewelry box 900 according to an exemplary embodiment. The jewelry box 900 comprises a lid member 902, a body region 904, and a plurality of feet 906 for engaging a surface. The jewelry box 900 further comprises an interior region 908 for receiving and storing the jewelry organizer 100.

Figure 10:
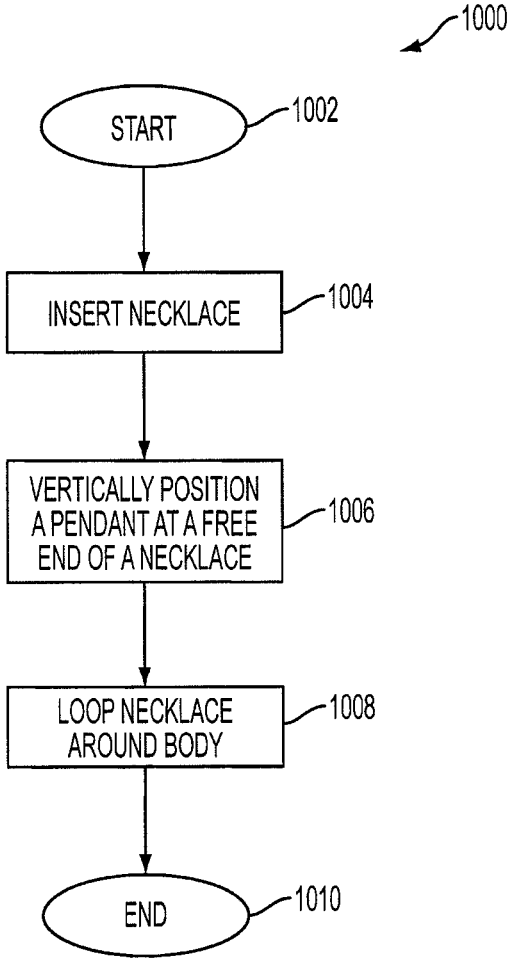
FIG. 10 is a flow diagram illustrating a method of using a jewelry organizer in conjunction with FIGS. 5 and 6A according to an exemplary embodiment.

FIG. 10 is a flow diagram illustrating a method of using the jewelry organizer 100 in conjunction with FIGS. 5 and 6A. The process 1000 starts at step 1002. At step 1004, a user inserts a portion of a clasped necklace 502 comprising a clasp member (not explicitly shown) within at least one securing member 118. At step 1006, a pendant 504 at a free end of the necklace 502 is positioned vertically below the at least one securing member 118 engaging the portion of the necklace 502. In a typical embodiment, the at least one securing member 118 and a top surface 104 of a body 102 provides sufficient frictional force to retain the portion of the necklace 502 in position and preclude the portion of the necklace 502 from shifting.

At step 1008, the user wraps the necklace 502 around an entire circumference of the body 102 until a free end of the necklace which may be, for example, the pendent 504 is positioned vertically below the body 102 between the at least one securing member 118 engaging the portion of the necklace and at least another adjacent securing member 118. At step 1010, the process 1000 ends. The arrangement of the necklace 502 as illustrated in FIGS. 5 and 6A prevents entanglement, knotting, and/or kinking of necklaces or other similar pieces of jewelry. The arrangement further provides display, support, and storage of jewelry in an attractive and demonstrative fashion that is easily provided and quickly available while still retaining the arrangement in an organized manner in storage.

Figure 11:
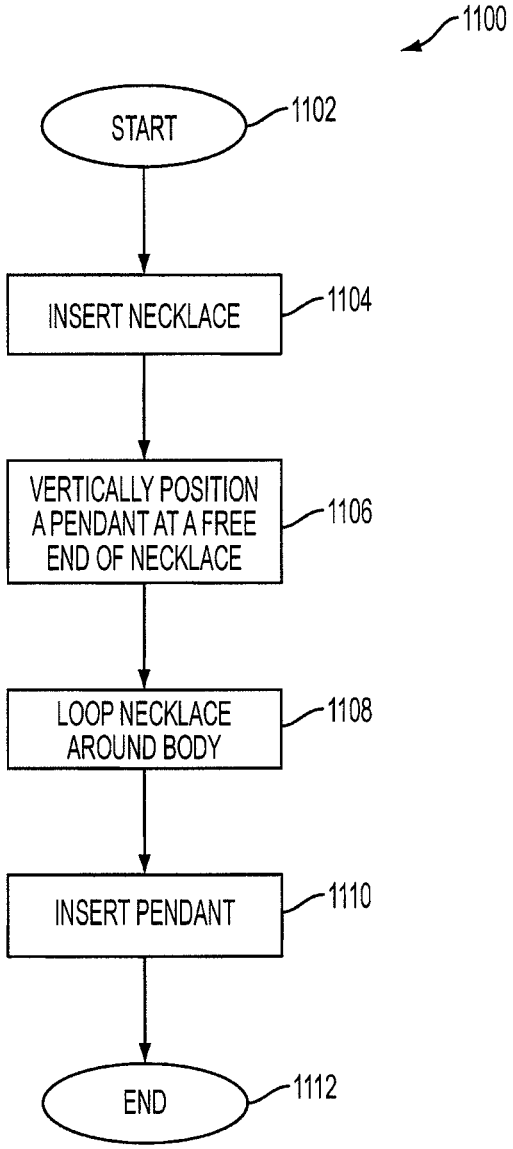
FIG. 11 is a flow diagram illustrating a method of using a jewelry organizer in conjunction with FIGS. 5 and 6B according to an alternate embodiment.

FIG. 11 is a flow diagram illustrating a method of using the jewelry organizer 100 in conjunction with FIGS. 5 and 6B. The process 1100 starts at step 1102. At step 1104, a user inserts a portion of a clasped necklace 502 comprising a clasp member (not explicitly shown) within at least one securing member 118. At step 1106, a pendant 504 at a free end of the necklace 502 is positioned vertically below the at least one securing member 118 engaging the portion of the necklace 502. In a typical embodiment, the at least one securing member 118 and a top surface 104 of a body 102 provides sufficient frictional force to retain the portion of the necklace 502 in position and preclude the portion of the necklace 502 from shifting.

At step 1108, the user wraps the necklace 502 around an entire circumference of the body 102 until the necklace 502 is unable to be wrapped around the body 102 and a free end of the necklace 502 which may be, for example, the pendent 504 is positioned vertically below at least one securing member 118 adjacent to the at least one securing member 118 engaging the portion of the necklace 502. In a typical embodiment, the necklace 502 is circumferentially wrapped around a body region between the at least one securing member 118 engaging the portion of the necklace 502 and at least another adjacent securing member 118. At step 1110, the pendant 504 is inserted between the at least another adjacent securing member 118 and the top surface 104 of the body 102. At step 1112, the process 1100 ends. The arrangement of the necklace 502 as illustrated in FIGS. 5 and 6B prevents entanglement, knotting, and/or kinking of necklaces or other similar pieces of jewelry. The arrangement further provides display, support, and storage of jewelry in an attractive and demonstrative fashion that is easily provided and quickly available while still retaining the arrangement in an organized manner in storage.

Although various embodiments of the apparatus of the invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein.

What is claimed is:

1. A jewelry organizer comprising:

a single piece, pliable body having a top surface, and a bottom surface, and a cover that surrounds the single piece body;

a plurality of peripheral securing members that are attached to the cover on the top surface of the single piece body and uniformly spaced apart adjacently along the top surface of the single piece body, wherein the plurality of peripheral securing members are attached to the cover by stitching, and wherein the plurality of peripheral securing members engage chain jewelry;

a first peripheral securing member on the top surface of the single piece body that securely engages a first end portion of a chain jewelry; and a second peripheral securing member on the top surface of the single piece body that securely engages a second end of the chain jewelry, wherein the first and second securing members are located adjacent to one another along the top surface of the single piece body;

wherein the chain jewelry is wrapped around a circumference of a portion of the single piece body between the first peripheral securing member and the second peripheral securing member such that the second end of the chain jewelry is positioned vertically below the second peripheral securing member and contacts the second peripheral securing member thus preventing the chain jewelry from unraveling from the single piece body, and further wherein the body provides sufficient frictional force due to the pliable nature to retain the wrapped chain jewelry in position and to prevent the wrapped portion of the chain jewelry from shifting and wherein the body is made from a soft, flexible and light-weight material.

2. The jewelry organizer according to claim 1, wherein the body is made from foam.

3. The jewelry organizer according to claim 1, wherein the cover is operable to function as an advertising medium by depicting information.

4. The jewelry organizer according to claim 1, wherein the first peripheral securing member engages a clasp region of the chain jewelry.

5. The jewelry organizer according to claim 1, wherein the plurality of peripheral securing members comprise buttons.

6. The jewelry organizer according to claim 1, wherein the jewelry organizer eliminates chain jewelry from at least one of entanglement, knotting, and kinking.

7. The jewelry organizer according to claim 1, wherein the chain jewelry comprises at least one of a necklace, a bracelet, and an ankle-bracelet.

8. The jewelry organizer according to claim 1, wherein the jewelry organizer is portable.

9. The jewelry organizer according to claim 1, wherein the jewelry organizer is stored within a jewelry box.

* * * * *